US006497409B2

(12) United States Patent
Mathews

(10) Patent No.: US 6,497,409 B2
(45) Date of Patent: Dec. 24, 2002

(54) METHOD FOR ROULETTE-TYPE GAMES

(76) Inventor: Marc Mathews, 5200 S. Lakeshore Dr., #118, Tempe, AZ (US) 85283

( * ) Notice: Subject to any disclaimer, the term of this patent is extended or adjusted under 35 U.S.C. 154(b) by 30 days.

(21) Appl. No.: 09/812,527

(22) Filed: Mar. 20, 2001

(65) Prior Publication Data

US 2001/0015525 A1 Aug. 23, 2001

Related U.S. Application Data

(63) Continuation of application No. 09/316,615, filed on May 21, 1999, now Pat. No. 6,209,869.

(60) Provisional application No. 60/086,859, filed on May 27, 1998.

(51) Int. Cl.[7] ..... A63F 5/02

(52) U.S. Cl. ..... 273/142 E; 273/138.1; 273/274; 273/142 R

(58) Field of Search ..... 273/274, 138.1, 273/138.2, 142 R, 142 E, 142 H, 142 HA

(56) References Cited

U.S. PATENT DOCUMENTS

| | | | | |
|---|---|---|---|---|
| 5,102,135 | A | 4/1992 | Addiechi | 273/142 E |
| 5,553,851 | A | 9/1996 | Malavazos et al. | 273/142 E |
| 5,636,838 | A | 6/1997 | Caro | 273/142 E |
| 5,755,440 | A | 5/1998 | Sher | 273/142 E |

FOREIGN PATENT DOCUMENTS

| | | | | |
|---|---|---|---|---|
| GB | 1113668 | * | 5/1968 | 273/274 |

* cited by examiner

*Primary Examiner*—Benjamin H. Layno

(57) ABSTRACT

A method for playing a roulette-type game includes the initial step of providing a playing field for betting on the conclusions of a plurality of gaming trials, prior to initiating the plurality of trials. The playing field restricts bets to create a house advantage. Once a bet is placed, the trials are initiated and the conclusion of each trial noted. The winning and losing bets are not determined until after the conclusion of the plurality of trials.

14 Claims, 3 Drawing Sheets

METHOD FOR ROULETTE-TYPE GAMES

CROSS-REFERENCES TO RELATED APPLICATIONS

This is a continuation application of Ser. No. 09/316,615 filed May 21, 1999, U.S. Pat. No. 6,209,869 entitled "METHOD AND APPARATUS FOR ROULETTE-TYPE GAMES", which claims the benefit of U.S. Provisional Application Serial No.60/086,859, filed May 27,1998.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to a roulette-type game, and more particularly to an improved method for playing such a game, utilizing a plurality of balls.

(2) Background Information

Gambling and games of chance are popular sources of entertainment for many people. Such games of chance are more enjoyable if a variety of different gaming apparatus are available to the player. New forms of gaming apparatus and new methods of playing existing games can generate new interests and enthusiasm in this activity.

One game that has been popular through the years is the game of roulette. In this game, a single rolling ball is propelled around a generally circular track in a direction opposite the rotation of a central wheel. Wagers are placed on the likelihood of the ball landing in a particular pocket or cassette formed around the perimeter of the central wheel.

While roulette has been a gaming apparatus present in casinos for many years, it has been becoming less popular in the recent past. While many reasons have been given for this reduction in popularity, today's gamblers have found conventional roulette to be "boring" and "too predictable" a game.

BRIEF SUMMARY OF THE INVENTION

It is therefore a general object of the present invention to provide an improved method for playing a roulette-type game.

A further object of the present invention is to provide a method for playing a roulette type game, which permits betting on the number of balls which may simultaneously fall within a single pocket, or within a specified group of pockets.

These and other objects will be apparent to those skilled in the art.

The method for playing a roulette-type game of the present invention includes the steps of:

(A) providing a first playing field for betting on the conclusions of a plurality of gaming trials, wherein the playing field restricts bets on at least one of the plurality of conclusions of each trial, to thereby create a house advantage;

(B) placing a bet as to the conclusions of each of the trials;

(C) initiating the trials;

(D) identifying the conclusions of each of the trials; and (E) determining winning and losing bets for the serial of trials.

The payout ratio for a winning bet includes the steps of:

(A) determining the house advantage for the playing field;

(B) determining a cumulative house advantage for the playing field;

(C) determining a single trial bet probability;

(D) multiplying the single trial bet probability times itself with an exponent equal to the number of trials in the game to produce a multiple trial bet probability;

(E) determining a payout variable by inverting the multiple trial bet probability to form a fraction having 1 as the numerator;

(F) determining a payout ratio numerator by multiplying the payout variable by the cumulative house advantage; and (G) designating the payout ratio denominator as 1.

BRIEF DESCRIPTION OF THE SEVERAL VIEWS OF THE DRAWING

The preferred embodiment of the present invention is illustrated in the accompanying drawings, in which similar or corresponding parts are identified with the same reference numeral throughout the several views, and in which.

DETAILED DESCRIPTION OF THE INVENTION

Figure 1:
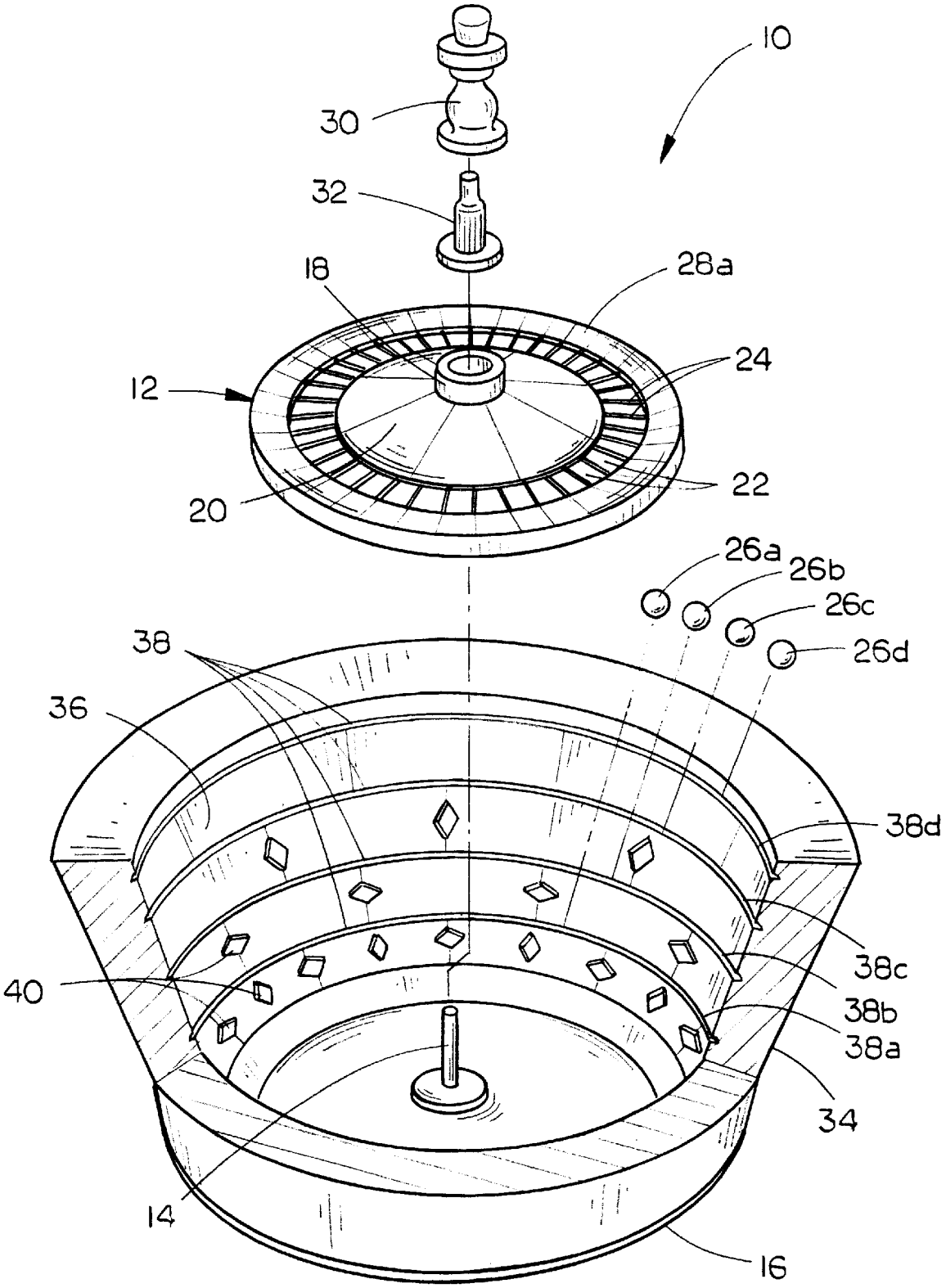
FIG. 1 is an exploded perspective view of the improved roulette wheel of the present invention, with portions shown in section.

Referring now to the drawings, and more particularly to FIG. 1, the improved roulette wheel of the present invention is designated generally at 10 and includes a disk 12 rotatably mounted on a shaft 14 projecting upwardly from a support base 16.

Disk 12 includes a central bearing housing 18 which rotatably connects the disk to shaft 14. A cone-shaped surface 20 extends radially outwardly and slopes downwardly from housing 18. Disk 12 has a plurality of pockets 22 extending radially outwardly and downwardly into the upper surface of disk 12 along the circumference of cone-shaped surface 20. Pockets 22 are separated by a plurality of radially extending frets 24, and open upwardly to receive balls 26*a*, 26*b*, 26*c*, and 26*d* therein, as described in more detail hereinbelow. An outer ring 28 extends around the circumference of pockets 24, and has a flat upper surface 28*a* upon which the numbers 00,0, and 1–36 are printed or engraved, adjacent each of the pockets 22. The numbers may be alternatively red and black, while the zeros are usually green.

A turret 30 is connected to a height adjuster 32 and mounted on the upper end of bearing housing 18, to assist in the manual spinning of disk 12. The stationary base 16 supports the rotatable disk 12 and includes a bowl 34 extending upwardly and outwardly from a position surrounding disk 12. Bowl 34 has a steeply sloped interior face 36 with a plurality of vertically spaced concentric annular grooves 38 forming independent tracks 38*a*, 38*b*, 38*c*, and 38*d* for balls 26*a*, 26*b*, 26*c*, and 26*d* . Each track 38 is designed to receive and retain a ball 26 as the ball is propelled in a circular motion along the track, but permit each ball to fall downwardly out of the track upon loss of a predetermined amount of its velocity, to thereby spiral downwardly and into one of the pockets 22 on the spinning disk 12. A plurality of projections 40 may be formed in the land portions of the interior face 36 between tracks 38, to thereby deflect balls 26 as they fall downwardly towards the spinning disk 12.

Figure 2:
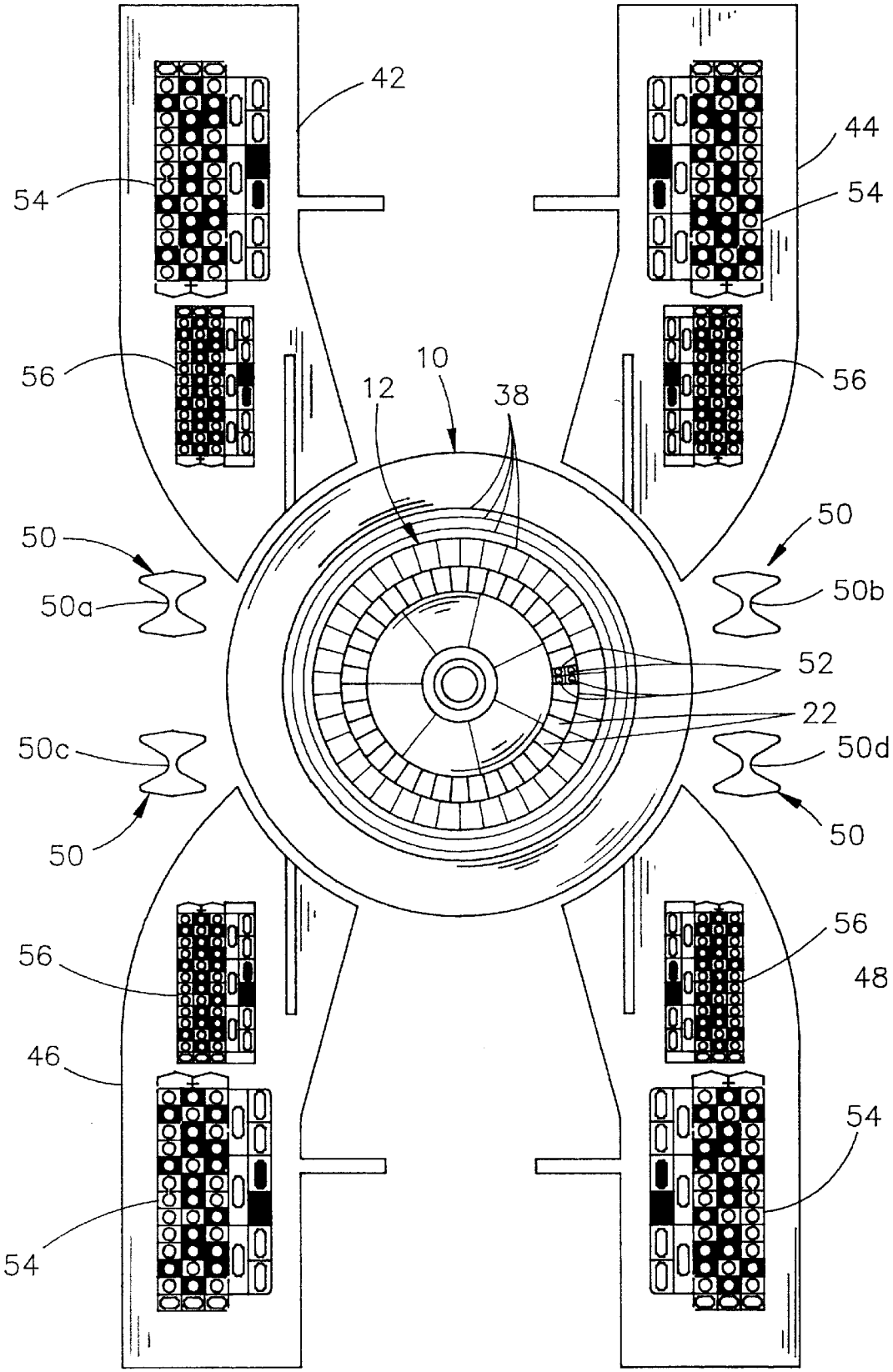
FIG. 2 is a plan view of a table configuration for the game.

Referring now to FIG. 2, a layout of the preferred embodiment of the roulette game of the present invention is shown in more detail. The roulette wheel 10 is preferably located generally centrally among four radially projecting tables 42, 44, 46, and 48. In order to associate each table with one of balls 26, it is preferred that each table have a colored top matching the color of the particular ball. Thus, in this case, table 42 is identified as a blue table and is associated with a blue colored ball 26*a,* table 44 is red and is associated with a red ball 26*b,* table 46 is purple and is associated with the purple ball 26*c,* and table 48 is green and is associated with green ball 26*d.* A vertical electronic display post 50 is provided for each table 42, 44, 46, and 48, and is located proximal the roulette wheel 10 and each table. Each post 50 has electronic display apparatus for displaying the number of the pocket within which the associated colored ball falls during play of the game. Thus, post 50*a* displays the location of blue ball 26*a,* post 50*b* shows the location of red ball 26*b,* post 50*c* shows the location of purple ball 26*c,* and post 50*d* shows the location of green ball 26*d.*

Each pocket 22 includes a plurality of sensors 52, each operable to detect one of the four balls 26*a,* 26*b,* 26*c,* and 26*d.* The sensors are shown in only one pocket in the drawings, and are well known in the art and will not be described in further detail herein. The sensors 52 are electrically connected to posts 50 to transmit information for display thereon. Posts 50 are preferably mounted to permit viewing from all four tables 42, 44, 46, and 48.

Each table 42, 44, 46, and 48 includes a lower playing field 54 and an upper playing field 56, upon which bets are placed for the roulette game. Playing fields 54 and 56 are identical on each table, and therefore only table 48 will be described in detail hereinbelow.

Figure 3:
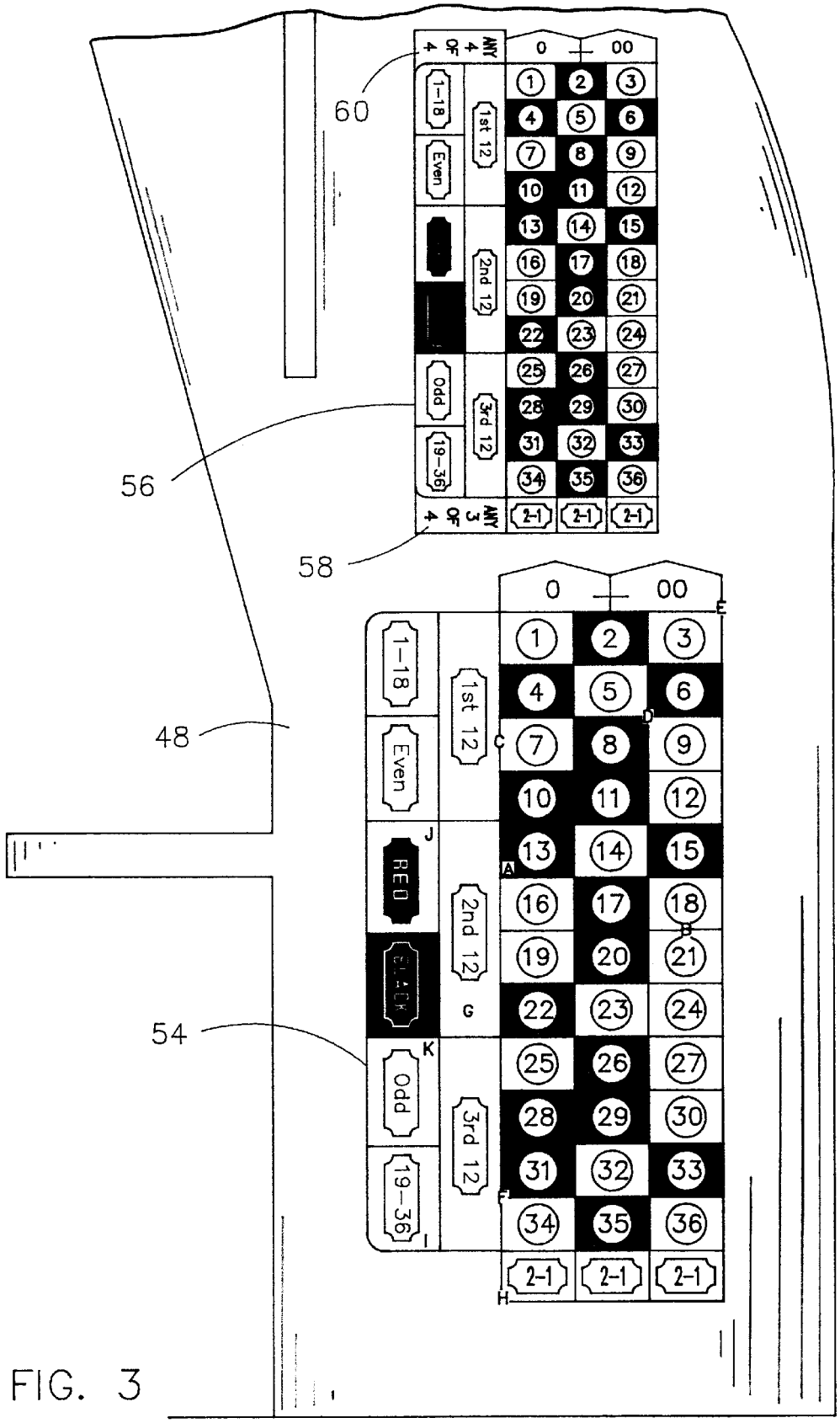
FIG. 3 is an enlarged plan view of one table of the game.

Referring now to FIG. 3, the green table 48 is shown in more detail. Table 48 has an upper and lower playing field 56 and 54, the upper playing field 56 utilized for placing bets on the plurality of balls 26, while lower playing field 54 is utilized to place bets on the single ball 26 which is associated with that particular table. In this case, lower field 54 would be utilized to place a bet on the green ball 26*d.* Lower playing field 54 is arranged in a conventional fashion for American roulette, having a "0" and a "00" on the wheel. Thus, the player may place any of the following different bets:

| Name of Bet | Number of Numbers Covered by Bet | Payout Ratio |
|---|---|---|
| A - Straight | 1 | 35/1 |
| B - Split | 2 | 17/1 |
| C - Street | 3 | 11/1 |
| D - Square | 4 | 8/1 |
| E - Line | 5 | 6/1 |
| F - Line | 6 | 5/1 |
| G - Dozens | 12 | 2/1 |
| H - Columns | 13 | 2/1 |
| I - High or low | 18 | 1/1 |
| J - Black or red | 18 | 1/1 |
| K - Even or odd | 18 | 1/1 |

Sample locations for each of the above-identified bets are marked on the lower table 54 with the letters A, B, C, D, E, F, G, H, I, J, K, respectively. Thus, it can be seen that the roulette game of the present invention may be played in the conventional fashion, placing bets on the ending location of a single ball into one of the pockets 22.

The addition of the upper playing field 56 permits new possibilities previously unknown in a roulette-type game. Upper field 56 is the same as lower field 54, but with the addition of two additional betting boxes 58 and 60. In the preferred embodiment of the invention, four balls are in play, and box 58 permits a bet of any three of the four balls falling within a single pocket. Similarly, betting box 60 envisions a four ball game with the bet covering all four of the balls falling within any single pocket. Obviously, the method of this game is equally applicable on games having either fewer or more balls in play, but with a minimum of two balls in play. In a two ball game, the upper layout would be utilized to cover both balls falling within the range of pockets allowed by the type of bet. Thus, if the bet were "straight up" both balls would have to fall within the same pocket. If the bet were "split" then the two balls would have to fall within one or both of the two pockets covered by the bet. Similarly, in a two ball game, betting box 58 would cover "any one of two" and betting box 60 would cover "any two of two".

In general, in games with "n" balls in play, betting box 58 would cover a bet for "any n−1 of n", while box 60 would cover bets on "any n of n". The estimated payment rate for bets on the upper playing field would be as follows, where 4 balls are used in the game:

| Name of Bet | Payment Ratio |
|---|---|
| 4 of 4 straight up | 1,666,667/1 |
| Split 4 of 4 | 100,000/1 |
| Any 4 of 4 | 40,000/1 |
| Street 4 of 4 | 20,000/1 |
| Any 3 of 4 | 250/1 |
| Dozens | 80/1 |
| High or Low | 15/1 |
| Black or Red | 15/1 |
| Even or Odd | 15/1 |

In addition, while the preferred embodiment of the invention utilizes a single roulette wheel with a plurality of tracks 38 for each of the balls in play, the method of the invention would work equally as well with a plurality of separate roulette wheels, each wheel having one or more tracks. The excitement in the game is the possibility of betting on a plurality of balls simultaneously, rather than merely on a single ball for each spin of the wheel.

In use, patrons will gather around each of tables 42, 44, 46, and 48, associated with each of the balls 26 to be utilized in the game. Patrons will then place allowable bets on the upper and/or lower playing fields 54 and 56 on their particular table. Croupiers then will put the four balls 26 into motion, one after another, from the lower most track 38*a* to the upper most track 38*d.* Preferably, the balls are placed into motion in a direction counter that of the rotation of the roulette wheel. As each ball loses momentum, it will spiral and bounce downwardly to finally fall within one of the pockets 22 on disk 12. The sensors 52 will detect the presence and location of each ball 26, and display the location on the associated post 50*a,* 50*b,* 50*c,* and 50*d.*

After the simultaneous display of the four numbers, a croupier at each table will designate the appropriate number on the lower playing field 54, and proceed to remove losing bets and payout winning bets. The process then begins again.

The method for determining the payout ratio for a particular bet in the improved quadroulette game, where either a plurality of balls are simultaneously propelled, or a single ball is propelled in a series of sequential spins, is the basis of a new method for playing a game of chance of the present invention. In order to determine the payout ratio for the upper playing field, it is first necessary to determine the house advantage and cumulative house advantage for the game. The house advantage for any playing field in a game of chance is determined by the proportionate number of possible conclusions in a trial in the game upon which a player's bets are restricted. For example, an American roulette wheel includes two locations on the wheel into which the ball may fall, but upon which a bet is greatly restricted. Thus, on any given spin of a 38 pocket roulette wheel, the house advantage is equal to 2 divided by 38 or 0.0526.

The probability of winning on a bet on any particular number on the roulette wheel must be adjusted to take this house advantage into consideration. Since two of the numbers are greatly restricted in the "betting pool", the actual probability for the bet must be adjusted to take the house advantage into account. The house advantage of 0.0526 must be factored into the single ball probability to obtain the actual payout to a player, where a house advantage is present.

In the upper playing field of the present invention, a plurality of balls are simultaneously set into play, each of those balls being subject to a house advantage. For this reason, to determine the upper layout payout ratio, the cumulative house advantage for all of the balls must be determined. The cumulative house advantage is equal to the number of unrestricted "bettable" positions divided by the total number of positions on the wheel, this quantity then being multiplied by itself with the exponent equal to the number of balls in the game. In the quadroulette game disclosed herein, the cumulative house advantage would be equal to $(36/38)^4$, which is equal to 0.805518681.

If the game is played with a single ball on a roulette wheel, this exponent would be equal to the number of sequential spins of the wheel, rather than the number of balls simultaneously propelled. Similarly, other games of chance would substitute the number of "trials" for the exponent in this equation.

The next step in determining the payout ratio for a winning bet includes the step of determining the single ball bet probability for a particular bet. As noted above, the single ball bet probability is equal to the total number of spaces which encompass the bet divided by the total number of spaces available on the wheel. Thus, if the bet is for a single number on a conventional American roulette wheel, the single ball bet probability would be equal 1/38. If the bet is for "dozens" the single ball probability would be 12/38.

The single ball bet probability is then multiplied times itself with the exponent equal to the number of balls in the game, in order to produce a multiple ball bet probability. A payout variable is then determined by inverting the multiple ball bet probability to form a fraction where the variable is equal to 1 divided by the multiple ball bet probability. This payout variable is then multiplied by the cumulative house advantage to form a product which is the numerator of the payout ratio. The denominator of the payout ratio is 1.

In the example of a bet on "dozens", the payout ratio would be determined as follows. First, the single ball bet probability is equal to $(12/38)^4$ which equals 0.009945. When inverted, this results in a payout variable of 100.55634. As noted above, the cumulative house advantage for the American style roulette wheel is equal to 0.805518681. Multiplying the cumulative house advantage times the payout variable results in a product of 81, which rounds to a payout ratio of 80/1. Technically, it is more accurate to subtract the one dollar bet from the variable before multiplying it by the cumulative house advantage. Thus, the more accurate payout ratio for a "dozens" bet would be $(100.5563271-1)\times 0.805518681=80$. Thus, if all four balls in the upper field are located in the particular 12 locations forming the "dozens" bet, the player would win a payout ratio of 80/1.

Obviously, this method could be used with other games of chance having different house advantages and different probabilities of winning, so long as the game of chance includes a plurality of gaming trials, with each trial including a plurality of possible conclusions.

Whereas the invention has been shown and described in connection with the preferred embodiment thereof, many modifications, substitutions and additions may be made which are within the intended broad scope of the appended claims.

I claim:

1. A method for playing a roulette game of the type having a plurality of at least three balls, and a roulette wheel with a plurality of numbered pockets, each pocket capable of receiving all of the balls simutaneously, comprising the steps of:

providing a playing field for betting on at least one pocket which will be the ending location of each of the plurality of balls;

the playing field restricting bets on at least one pocket to create a house advantage for the playing field;

placing a bet as to the ending location of the balls at the outcome of a round;

propelling all of the balls along tracks on the wheel;

identifying the pockets in which each of the balls resides at the outcome of the round; and determining winning and losing bets.

2. The method of claim 1, further comprising the step of determining the payout ratio for a winning bet, comprising the steps of:

determining the house advantage for the playing field;

determining a cumulative house advantage for the playing field;

determining a single ball bet probability;

multiplying the single ball bet probability times itself with an exponent equal to the number of balls in the game to produce a multiple ball bet probability;

determining a payout variable by inverting the multiple ball bet probability to form a fraction having 1 as the numerator;

determining a payout ratio numerator by multiplying the payout variable by the cumulative house advantage; and designating the payout ratio denominator as 1.

3. The method of claim 2, wherein the step of determining the payout ratio numerator includes the step of subtracting 1 from the payout variable prior to the step of determining the payout ratio numerator.

4. A method for playing a roulette game of the type having a ball and a roulette wheel, the wheel having a plurality of numbered pockets for receiving the ball, comprising the steps of:

providing a first playing field for betting on the pocket which will be an ending location of the ball;

the playing field restricting bets on at least one pocket to create a house advantage for the playing field;

before initiating any spin of the wheel, placing a bet as to ending locations of the ball at the outcome of a plurality of sequential spins wherein the bet placed representing the ending location of the ball after each sequential spin;

initiating the plurality of sequential spins without permitting any bets to be added or changed during the plurality of sequential spins;

identifying the pocket in which the ball resides at the outcome of each spin;

determining winning and losing bets at the conclusion of said plurality of sequential spins.

5. The method of claim 4, further comprising the step of determining the payout ratio for a winning bet, comprising the steps of:

determining the house advantage for the playing field;

determining a cumulative house advantage for the playing field;

determining a single spin bet probability;

multiplying the single spin bet probability times itself with an exponent equal to the total number of sequential spins in the game, to produce a multiple spin bet probability;

determining a payout variable by inverting the multiple spin bet probability to form a fraction having 1 as the numerator;

determining a payout ratio numerator by multiplying the payout variable by the cumulative house advantage; and designating the payout ratio denominator as 1.

6. The method of claim 5, wherein the step of determining the payout ratio numerator includes the step of subtracting 1 from the payout variable prior to the step of determining the payout ratio numerator.

7. A method for playing a roulette game of the type having a ball and a roulette wheel, the wheel having a plurality of numbered pockets for receiving the ball, comprising the steps of:

providing a first playing field for betting on the pocket which will be an ending location of the ball;

the playing field not permitting a bet on at least one pocket to thereby create a house advantage;

before initiating any spin of the wheel, placing a bet as to ending locations of the ball at the outcome of a plurality of sequential spins wherein the bet placed representing the ending location of the ball after each sequential spin;

initiating a plurality of independent spins of the roulette wheel in a first direction without permitting any bets to be added or changed during the plurality of sequential spins;

propelling the ball along a track on the wheel in a second direction opposite the first direction after each spin initiation;

identifying the pocket in which the ball resides at the outcome of each of the spins;

determining winning and losing bets at the conclusion of said series of spins.

8. The method of claim 7, further comprising the step of determining the payout ratio for a winning bet, comprising the steps of:

determining the house advantage for the playing field;

determining a cumulative house advantage for the playing field;

determining a single spin bet probability;

multiplying the single spin bet probability times itself with an exponent equal to the total number of sequential spins in the game, to produce a multiple spin bet probability;

determining a payout variable by inverting the multiple spin bet probability to form a fraction having 1 as the numerator;

determining a payout ratio numerator by multiplying the payout variable by the cumulative house advantage; and designating the payout ratio denominator as 1.

9. The method of claim 8, wherein the step of determining the payout ratio numerator includes the step of subtracting 1 from the payout variable prior to the step of determining the payout ratio numerator.

10. A method for playing a game of chance which includes a plurality of gaming trials, each trial including a plurality of possible conclusions, comprising the steps of:

providing a first playing field for betting on the conclusions of the plurality of gaming trials, wherein the playing field restricts bets on at least one of the plurality of conclusions of each trial, to thereby create a house advantage;

placing a bet as to the conclusions of each of the trials prior to initiating any of the plurality of trials;

initiating the trials without permitting any bets to be added or changed during the plurality of trials;

identifying the conclusions of each of the trials; and determining winning and losing bets at the conclusion of said series of trials.

11. The method of claim 10, further comprising the step of determining the payout ratio for a winning bet, comprising the steps of:

determining the house advantage for the playing field;

determining a cumulative house advantage for the playing field;

determining a single trial bet probability;

multiplying the single trial bet probability times itself with an exponent equal to the number of trials in the game to produce a multiple trial bet probability;

determining a payout variable by inverting the multiple trial bet probability to form a fraction having 1 as the numerator;

determining a payout ratio numerator by multiplying the payout variable by the cumulative house advantage; and designating the payout ratio denominator as 1.

12. The method of claim 11, wherein the game of chance includes a roulette wheel with at least one ball associated with the wheel, wherein each trial is a spin of the wheel and propelling the ball around a track on the wheel, and wherein each conclusion is the ending location of the ball on the wheel after a spin.

13. The method of claim 11, wherein the game of chance includes a roulette wheel with a plurality of balls associated with a plurality of tracks on the wheel, wherein each trial is the propelling of a ball around the tracks, and wherein each conclusion is the ending location of each of the balls on the wheel after a spin.

14. The method of claim 13, wherein the trials occur with a single spin of the wheel while the balls are propelled on the tracks of the spinning wheel.

* * * * *